United States Patent [19]

Hagewood

[11] Patent Number: 4,860,821

[45] Date of Patent: Aug. 29, 1989

[54] PROCESS FOR CLEANING TUBE TYPE HEAT EXCHANGERS

[76] Inventor: Brown T. Hagewood, 35 Jerome Dr., Glen Cove, N.Y. 11542

[21] Appl. No.: 219,476

[22] Filed: Jul. 15, 1988

[51] Int. Cl.[4] ..... F28G 9/00

[52] U.S. Cl. ..... 165/95; 15/104.061; 122/390

[58] Field of Search ..... 165/95; 15/104.03, 104.05, 15/104.061, 104.062; 134/7, 8; 122/379, 390, 401

[56] References Cited

U.S. PATENT DOCUMENTS 4,543,131 9/1985 Purinton ..... 134/8
4,716,611 1/1988 Barry ..... 134/8 X

FOREIGN PATENT DOCUMENTS 0215847 11/1984 Fed. Rep. of Germany ..... 165/95
2501357 9/1982 France ..... 165/95
0059679 4/1982 Japan ..... 15/104.061
0651189 3/1979 U.S.S.R. ..... 165/95

*Primary Examiner*—Margaret A. Focarino
*Attorney, Agent, or Firm*—Michael I. Kroll

[57] ABSTRACT

An improved process for cleaning heat exchanger tubes using propellant water to shoot pigs, brushes, scrapers, or similar devices through the heat exchanger tubes. The improvement includes adding treatment chemicals individually or in combination to the propellant water so that corrosion, mechanical wear, or scaling of the heat exchanger tubes are controlled. The treatment chemicals include, but are not limited to, ferrous sulfate, sodium hypochlorite, or hydrogen peroxide. Other chemicals, such as, oxidizers, reducers, acids, bases, inorganics and organics when added in sufficient concentration will reduce heat exchanger tube corrosion, mechanical wear and scale.

11 Claims, 3 Drawing Sheets

CONDENSER: CORRECTED BACK PRESSURE (INCHES Hg)

| 1988 | MONTHLY AVERAGE BT 1 | MONTHLY AVERAGE BT 2 | UNIT Δ BEFORE TREATMENT | UNIT Δ AFTER TREATMENT |
|---|---|---|---|---|
| MARCH | .2848 | .5335 | .2487 | |
| APRIL | .4531 | .5303 | .0772 | |
| JUNE | .0755 | .4363 | | .3608 |
| JULY | .1468 | .6600 | | .5132 |
| AUG. | .2226 | .9153 | | .6893 |
| | | COLUMN AVERAGE | .1630 * | .5211 |

* .3581"Hg IMPROVEMENT ATTRIBUTED TO TREATMENT PROCESS.

CONDENSER: NUMBER OF BRUSHINGS

| 1988 | BT 1 | BT 2 | UNIT Δ BEFORE TREATMENT | UNIT Δ AFTER TREATMENT |
|---|---|---|---|---|
| MARCH | 1.25 | 3.50 | 2.25 | |
| APRIL | 2.25 | .75 | -1.50 | |
| JUNE | 2.00 | 3.50 | | 1.50 |
| JULY | .75 | 5.00 | | 4.25 |
| AUG. | 1.25 | 3.75 | | 2.50 |
| | | COLUMN AVERAGE | .375 * | 2.75 |

* 2.375 REDUCTION IN BRUSHINGS/MONTH ATTRIBUTED TO TREATMENT PROCESS.

B: PRESSURE

Figure 3

PROCESS FOR CLEANING TUBE TYPE HEAT EXCHANGERS

BACKGROUND OF THE INVENTION

1. Field of the Invention

The present invention relates to tube type heat exchangers. More particularly, the present invention relates to a process for cleaning tube type heat exchangers.

2. Description of the Prior Art

In the manufacture of heat exchangers, especially those of the shell and tube type wherein the interior of the shell houses a plurality of tubes whose ends are mounted to a tube sheet that closes the end of the shell, it is necessary that one of the final stages of the fabrication process include that of cleaning the interior of the assembled tubes. This need arises from the fact that during the various steps of the fabrication process the deposition of dirt, metal chips and other, sediment in the tubes is inescapable. Moreover, prior to completion of the assembly, it must be heat treated which results in the generation of metal oxides within the tubes. To remove these oxides, the tubes are subjected to acid pickling and thereafter it is necessary to clean the tubes to insure that no acid residue remains in the tubes upon completion of the pickling step since the presence of such acid would ultimately result in contamination of the fluid passed through the tubes during operation of the heat exchanger.

In the past, it has been the practice to clean the tubes of such heat exchangers by manually driving a swab attached to a wire or the like through the tube. This is both a laborious and time consuming procedure especially when it is considered that it is not uncommon for heat exchangers of this type to include thousands of tubes.

U.S. Pat. No. 3,631,555 to Linz et al teaches an apparatus operable to propel a cleaning pellet by means of compressed air or other motive fluid through the interior of the tubes assembled in the tube sheet of a heat exchanger or other similar equipment.

The efficiency of a heat exchanger of the shelltube type is unavoidably lessened after some time of operation due to deposits on the tube walls, especially to deposits along the inner tube walls. Such deposits may be caused by mechanical impurities carried by the media flowing through the tubes which condense along the tube walls or by substances contained in the media in a state of solution but precipitated therefrom by thermal and/or chemical influences. These deposits impede the heat transition to transfer through the tube walls and thereby deteriorate the efficiency of the heat exchanger. When this efficiency is lowered to a certain fraction of the original efficiency thereof, the tubes have to be cleaned mechanically and/or chemically to restore the original efficiency.

U.S. Pat. No. 4,237,962 to Vandenhoeck teaches a particulate cleaning medium introduced between the inlet ends of the tubes and the tube sheet and is then forced in a direction counter to the direction of flow of the first fluid through the tubes along the exterior surfaces of the tubes to the inlet ends of the tubes so that the particulate cleaning matter is introduced into the tubes and is directed against the inner walls of the tubes as the direction of flow is changed so that the particulate cleaning media flows through the tubes in the direction of the flow of the first fluid.

Many methods and apparatus are in use for removing impurities and other noxious substances from the medium passing through the pipes or tubes and for periodically cleaning these tubes. For instance, chlorine is added to the fresh cooling water for precipitating the above-named organic substances entering into the tubes. Or, in the alternative, mechanical impurities are removed by filtering the fresh water. Furthermore, in circulatory cooling systems the increased hardness of the circulating cooling water due to evaporation is counteracted by chemically softening the water. As a rule, the pipes or tubes of the tube-type heat exchangers are only periodically cleaned by mechanically and/or chemically removing the above-named deposits from the tube walls.

Loose sludge may be removed by increasing the velocity of the cooling water, by heat exchanger rinsers and the like, solid sludge is removed by ordinary wire brushes, while very hard sludge deposits are drilled out, and solid stone, such as lime, deposits are dissolved chemically.

Due to the fact that each subsequent cleaning of the heat exchanger can only be effected after a certain finite period of time, the level of average heat transfer of the cooling tubes, or of the heat exchanger efficiency is, in many cases considerably, lower than the maximum values obtained immediately after the cleaning. For reasons connected with the particular operation of the particular plant the operating period of the heat exchanger ascertained as being economical sometimes has to be exceeded, the average vacuum of the heat exchanger being further impaired as a necessary consequence thereof.

U.S. Pat. No. 3,021,117 to Taprogge teaches an apparatus for self-cleaning vacuum heat exchangers.

Pipeline efficiency and volume can be lost by scale build up in the interior lining of the pipe. Mechanical pigs and/or gelled chemical pigs have been used to remove the scale. The mechanical pigs ar normally solid bullet-shaped devices which have wire brushes or abrasive surfaces to physically abrade the scale interior of the pipe. The gelled chemical pigs, on the other hand, remove the surface deposits by dissolution and/or by picking up loose debris as they pass through the pipeline.

U.S. Pat. No. 4,543,131 to Purinton, Jr. teaches a method of cleaning the interior of pipelines. The method includes passing an aqueous gelled pig containing an aqueous, cross-linked gelled galactomannan gum, or derivative, through the pipeline.

U.S. Pat. No. 4,216,026 to Scott teaches a method for cleaning pipelines using an aqueous gel in which plugs of Bingham plastic fluids are effective in picking up loose debris and minor amounts of liquids as the plug moves through the pipeline. The plug is used in combination with mechanical scrapers.

U.S. Pat. No. 4,003,393 to Jagger et al. also teaches a method of removing fluids and solids from a pipeline using an organic liquid gel with a metal salt of an aliphatic ester or orthophosphoric acid.

While the aforementioned aqueous gels have many desirable properties, certain types of scale or scale components are effectively removed only by an organic solvent. In most instances, a "fill and soak" type treatment with a liquid solvent is not practical due to th volume of solvent required. Waste disposal of such a large volume of material is also a commercial problem.

There are many organic gels described in the literature. For example, U.S. Pat. No. 3,505,374 to Monroe teaches the use of magnetite salts of alkyl oleyl orthophosphate as gelling agent for hydrocarbons and halogenated hydrocarbon liquids. U.S. Pat. No. 3,757,864 to Crawford et al. teaches that the pressure drop of a confined non-polar organic liquid in motion due to friction is lessened by admixing with the liquid one or more aluminum salts of an aliphatic orthophosphate ester. U.S. Pat. No. 3,757,864 to Crawford et al. also teaches that such esters can gel the liquids. U.S. Pat. No. 3,219,619 to Dickerson teaches thickened hydrocarbons with t-butylstyrene interpolymers containing metal carboxylate groups. U.S. Pat. No. 3,527,582 to Haigh et al. teaches reversible gels of liquid hydrocarbons using a crosslinked latex polymer of an alkyl styrene. But, as U.S. Pat. No. 3,505,374 to Monroe teaches, thickened organic fluids are not the same as organic gels.

With organic gels, the gel consistency will not disappear on dissolution of the gel. With sufficient dissolution, the solvent swollen gelling agent will appear as a distinct phase in suspension. Moreover, the gel structure has a viscosity profile that is quite different from liquids that are merely thickened but not gelled.

If a gel is to be used as a pipeline pig, the rheology and chemical and physical properties of the gel must meet certain demands. For example, the gel must be viscoelastic and self-sustaining so that it will not break up as it is being forced through the line under pressure. It is also desirable for the gel to have the capacity to retain suspended solids and the ability to sustain a gel/-liquid interface. This later capability is needed because in many instances it is desirable to displace with the gelled pig and/or to drive the pig directly with a liquid under pressure. Also, it is desirable in many instances to use a pig train which will have one or more chemical pig segments and the gel desirably would have a gel structure that would prohibit or substantially inhibit comingling of liquids in front of and/or behind the gelled pig (sometimes called fluid by-pass).

It has now been discovered that organic gels that include: (a) a non-polar, liquid, organic solvent and (b) a gelling amount of a mixture of (1) an alkyl oleyl phosphate and (2) an alkali metal aluminate, have very desirable properties. U.S. Pat. No. 4,473,408 to Purinton, Jr. teaches these organic gels can be used as gelled pigs to remove organic soluble scale or scale contaminants from pipeline and can also be used in a variety of other ways.

U.S. Pat. No. 3,415,729 to Dana teaches a method for removing paraffin deposited on the inside of the well tubing or of the oil discharged line of oil wells.

U.S. Pat. No. 3,384,512 to Frederick teaches a pigging device launching detecting system. Means are provided for launching a pigging device into a carrying line. An electrical sensing means is provided for responding to the passage of a magnet-containing pigging device past a predetermined point in the pipeline. Control means are operable in response to signals from the electrical sensing means and are adapted to regulate the launching means.

U.S. Pat. No. 3,209,771 teaches the use of gelled bodies for separating two fluids flowing in a pipeline. U.S. Pat. No. 3,225,787 teaches an attempt to improve the technique of U.S. Pat. No. 3,209,771 by employing an elongated gel filled pipeline pig having elastic reinforced rubber sidewalls and thickened ends. The latter technique was employed to overcome the problem of the gelled body of U.S. Pat. No. 3,209,771 breaking down in long pipelines. However while solving this problem several new problems ensued. First, due to the thick walls of the pig taught in U.S. Pat. No. 3,225,787 the pig lost some of its flexibility and tended to be blocked by "stalactites" located at welded joints in the line. Furthermore, the pig could only be employed in one size pipeline. Canadian Patent No. 903,621 teaches a device to overcome the blocking problem by employing an elongated gel-filled pipeline having thin lateral walls and elastic end walls. The walls are sufficiently thin so that they are ripped by stalactites and flow on without substantial pressure build-up.

An ideal pipeline pig would be a gelled self-sustaining mass which does not break up in line pipelines and which can be readily converted to a liquid for disposal at the end of the flow cycle. Furthermore, it would be preferable if the pig could change size so that it could flow through different size conduits.

U.S. Pat. No. 4,003,393 to Jaggard et al. teaches a gel-like mass which does not break up in long pipelines and which can readily be returned to a liquid form at the end of the use cycle. In addition, the pig can be flowed directly from one size pipe to another. Also, the gelled pig can be employed as a wiper plug to remove various fluids (e.g. hydrocarbons, asphaltines, paraffins), solids and semi-solids such as sand, tar, corrosion products and the like from conduits. The gel not only wipes surfaces clean but can absorb a substantial amount of water without breaking down.

U.S. Pat. No. 3,565,689 to Lowe et al. teaches a source of dry pressured gas applied about a rear end surface of an elongated projectile in a confined space to propel the projectile into the interior of a tube to be purged of liquid and liquid vapor. The supply of gas is maintained under pressure about the rear end surface of the projectile to drive it toward a remote open end of the tube.

U.S. Pat. No. 4,440,194 to Kinumoto et al. teaches moving bodies for performing work in the interior of pipes for transporting town gas, petroleum, water and like fluids, and to a method of performing work within pipes with use of such a body.

As shown, supra, numerous innovations for cleaning pipes have been provided in the prior art that are adapted to be used to accomplish work in the performance of specific individual operations. While these innovations may be suitable for the specific individual purposes to which they address, they would not be suitable for the purposes of the present invention as heretofore described.

SUMMARY OF THE INVENTION

Accordingly, it is an object of the present invention to provide an improved process for cleaning tube type heat exchangers which avoids the disadvantages of the prior art.

More particularly, it is an object of the present invention to provide an improved process for cleaning tube type heat exchangers which controls corrosion scale, and mechanical wear associated with biota, reduces heat exchanger tube leaks, reduces maintenance, reduces rate of corrosion or "plugging" in the tubes, extends tube life, and improves heat rate.

Additionally, the improved process for cleaning tube type heat exchangers of the present invention has three major advantages over the conventional conditioning of the heat exchanger coolant. Firstly, the concentration of the treatment chemical can be increased to the percentile range which is substantially more effective than the ppb or low ppm range used when conditioning the heat exchanger coolant. Secondly, the waste and "unused" treatment chemical can be captured and treated by the wastewater treatment plant (WWTP) thus eliminating environmental hazards. Thirdly, the treatment cost will be substantially less since only a few pounds of chemical per shooting will be required instead of the hundreds, even thousands, of pounds needed for treating the coolant for comparable service periods.

In keeping with these objects, and with others which will become apparent hereinafter, one feature of the present invention resides, briefly stated, in an improved process for cleaning heat exchanger tubes using air and water propellant mixture to shoot pigs, brushes, or scrapers or other similar devices through the heat exchanger tubes wherein the improvement includes adding a treatment chemical to the propellant water.

When the improved process for heat exchanger tubes is designed in accordance with the present invention, corrosion and scaling and mechanical wear of the heat exchanger tubes are controlled and the treatment chemical is environmentally acceptable because the waste is captured and processed in an approved waste water treatment plant and sufficiently less costly because only a few pounds of chemicals are required per treatment and being a variety of chemicals used singularly and in combination.

In accordance with another feature of the present invention, the treatment chemical is at least 10,000 ppm. Another feature of the present invention is that the treatment chemical inorganic.

Yet another feature of the present invention is that the treatment chemical is organic.

Still another feature of the present invention is that the treatment chemical is an acid.

Yet still another feature of the present invention is that the treatment chemical is a base.

Still yet another feature of the present invention is that the treatment chemical is an oxidizer.

Another feature of the present invention is that the treatment chemical is a reducer.

Yet another feature of the present invention is that the treatment chemical is ferrous sulfate.

Still another feature of the present invention is that the treatment chemical is sodium hypochlorite.

Finally still a further feature of the present invention is that the treatment chemical is hydrogen peroxide.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 3 is a table showing the effectiveness and economy of the present invention.

LIST OF REFERENCE NUMERALS

Figure 1:
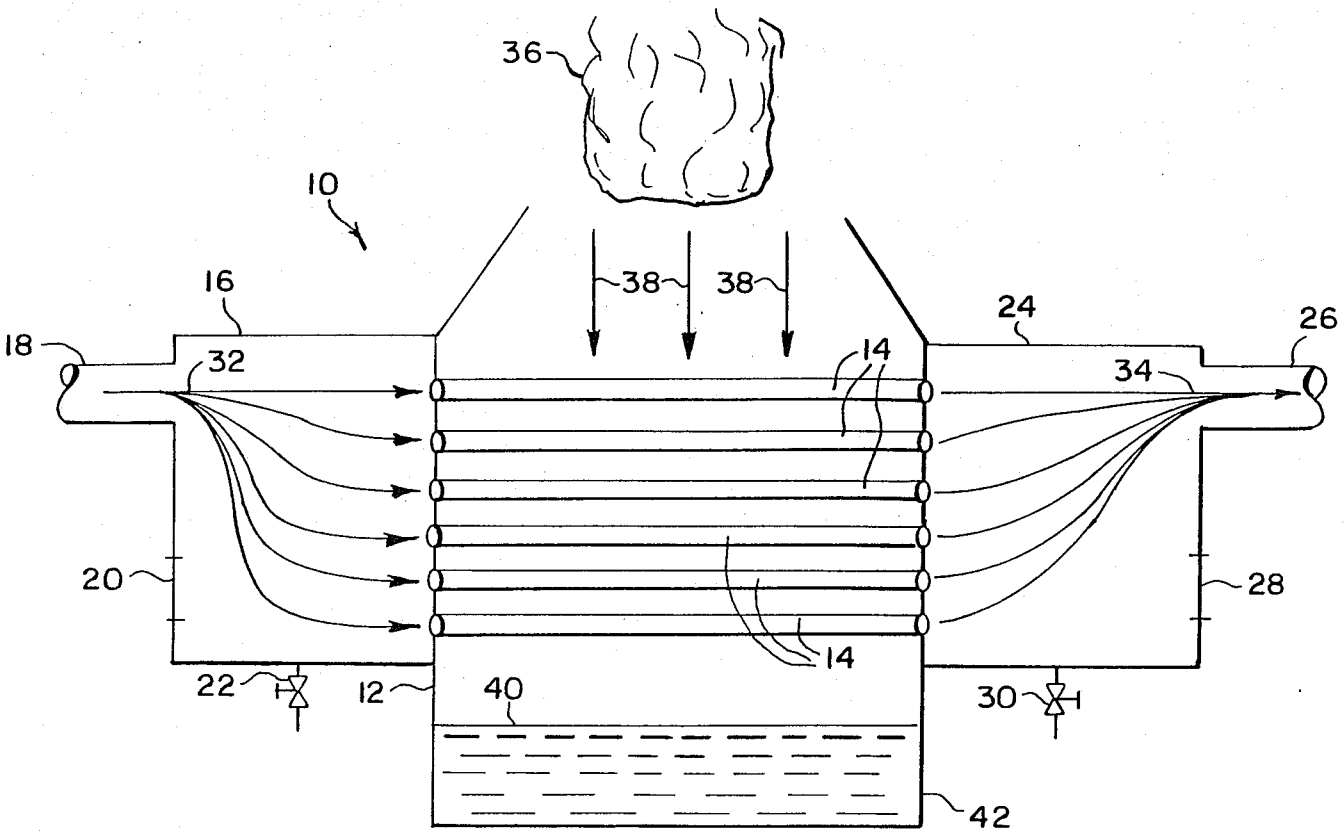
FIG. 1 is a side view generally showing a tube type heat exchanger.

10—heat exchanger
12—main body of the heat exchanger 10
14—plurality of straight parallel hollow tubes of the heat exchanger 10
16—inlet water box of the heat exchanger 10
18—coolant inlet of the inlet water box 16
20—manhole access in the inlet water box 16
22—drain valve in the inlet water box 16
24—outlet water box of the heat exchanger 10
26—coolant outlet of the outlet water box 24
28—manhole access in the outlet water box 24
30—drain valve in the outlet water box 24
32—direction of arrows of coolant entering the coolant inlet 18
34—direction of arrows of coolant exiting the outlet water box 24
36—turbine exhaust steam
38—direction of arrows of steam exhaust from the turbine
40—condensate
42—bottom of the main body 12 of the heat exchanger
44—gun
46—first hose
48—air supply
50—valve in the first hose 46
52—gauge in the first hose 46
54—second hose
56—water supply
58—valve in the second hose 54
60—gauge in the second hose 54
62—third hose
63—chemical additive supply
64—valve in the third hose 62
66—gauge in the third hose 62
68—pig, brush, scraper or other similar device
70—total waste
73—waste water treatment plant

DETAILED DESCRIPTION OF THE PREFERRED EMBODIMENTS

Periodically heat exchangers are taken out of normal service and the tubes are cleaned with a plastic pig, nylon brush, metallic scraper or other similar device propelled through the tube, one at a time, by air and water controlled via a "gun". Pigging, brushing and scraping removes most of the biota but does not kill it. The addition of an appropriate chemical to the "shot" water kills the biota thus promoting a more effective cleaning and corrosion, scale and mechanical wear control. Cooling water is usually salt water, brackish water or fresh water and can be of the once-through, multipass or recirculating type. All cooling waters have biota which tends to thrive in the elevated temperatures of heat exchangers.

The present invention chemically treats the "shotwater" used to propel brushes, pigs, scrapers or other similar devices when cleaning heat exchanger tubes and captures the waste for processing in an approved waste treatment plant.

A variety of chemicals individually or in combination may be used to form protective oxide coating, control biota cycles, retard and arrest general corrosion, remove and control scale, etc. and resist mechanical wear. The chemicals include, but are not restricted to, ferrous sulfate, hydrogen peroxide and sodium hypochlorite to concentrations of 1000, 2000, 10,000 ppm or higher. The system has application potential for all common heat exchanger tube alloys, including but not limited to, aluminum-brass, admiralty, copper-nickel alloys, austenitic and ferritic stainless steels and titanium.

Hydrogen peroxide ($H_2O_2$) and sodium hypochlorite (NaOCl) propellant water treatment show even greater promise than ferrous sulfate in biota control.

The chemicals mentioned, supra, have potential in the process depending on the corrosion mechanism and the heat exchanger or heat exchanger alloy. Oxidizing and reducing chemicals are effective against salt water, brackish and fresh water biota induced corrosion in Al-Brass tubing, including $FeSO_4$ (ferrous sulfate), NaOCl (sodium hypochlorite) and $H_2O_2$ (hydrogen peroxide). Acids and bases are effective providing they do not consume the tubing alloy. Other chemicals that disrupt the corrosion process are also effective. Such chemicals could be organic or inorganic.

Referring now to FIG. 1, a heat exchanger is shown generally at 10. Th heat exchanger 10 includes a main body 12 containing a plurality of straight parallel hollow tubes 14. On one side of the main body 12 is located an inlet water box 16. The inlet water box 16 contains a coolant inlet 18, a manhole access 20, and a drain valve 22. On the opposite side of the main body 12 is located an outlet water box 24. The outlet water box 24 contains a coolant outlet 26, a manhole access 28, and a drain valve 30.

In operation of the tube type heat exchanger, the coolant enters the coolant inlet 18 and travels in the direction of arrows 32. As the coolant fills the inlet water box 16, it enters the plurality of straight parallel hollow tubes 14 and proceeds to pass therethrough. As the coolant exits the plurality of straight parallel hollow tubes 14, it fills the outlet water box 24. The coolant then exits the outlet water box 24 in the direction of arrows 34, via the coolant outlet 26.

By passing the coolant through the plurality of straight parallel hollow tubes 14, the plurality of straight parallel hollow tubes 14, themselves, become cool.

It should be noted that if the inlet water box requires drainage, the drain valve 22 is provided therefor. Likewise, if the outlet water box requires drainage, the drain valve 30 is provided therefor.

As turbine exhaust steam 36 enters the main body 12 of the heat exchanger 10 in the direction of arrows 38, it passes over the cool plurality of straight parallel hollow tubes 14. As the turbine exhaust steam 36 continues to pass over the cool plurality of straight parallel hollow tubes 14, it gives up its energy in heat to the coolant and condenses into a liquid 40 at the bottom of the main body 12 of the heat exchanger 10.

The coolant that exits the plurality of straight parallel hollow tubes 14 has become warmer. The coolant is cooled.

It can be seen that with the continual flow of the coolant through the plurality of straight parallel hollow tubes 14, the plurality of straight parallel hollow tubes 14 would become contaminated and lose overall efficiency. In order to prevent a decrease in the overall efficiency, the plurality of straight parallel hollow tubes 14 must be purged of contaminants.

Figure 2:
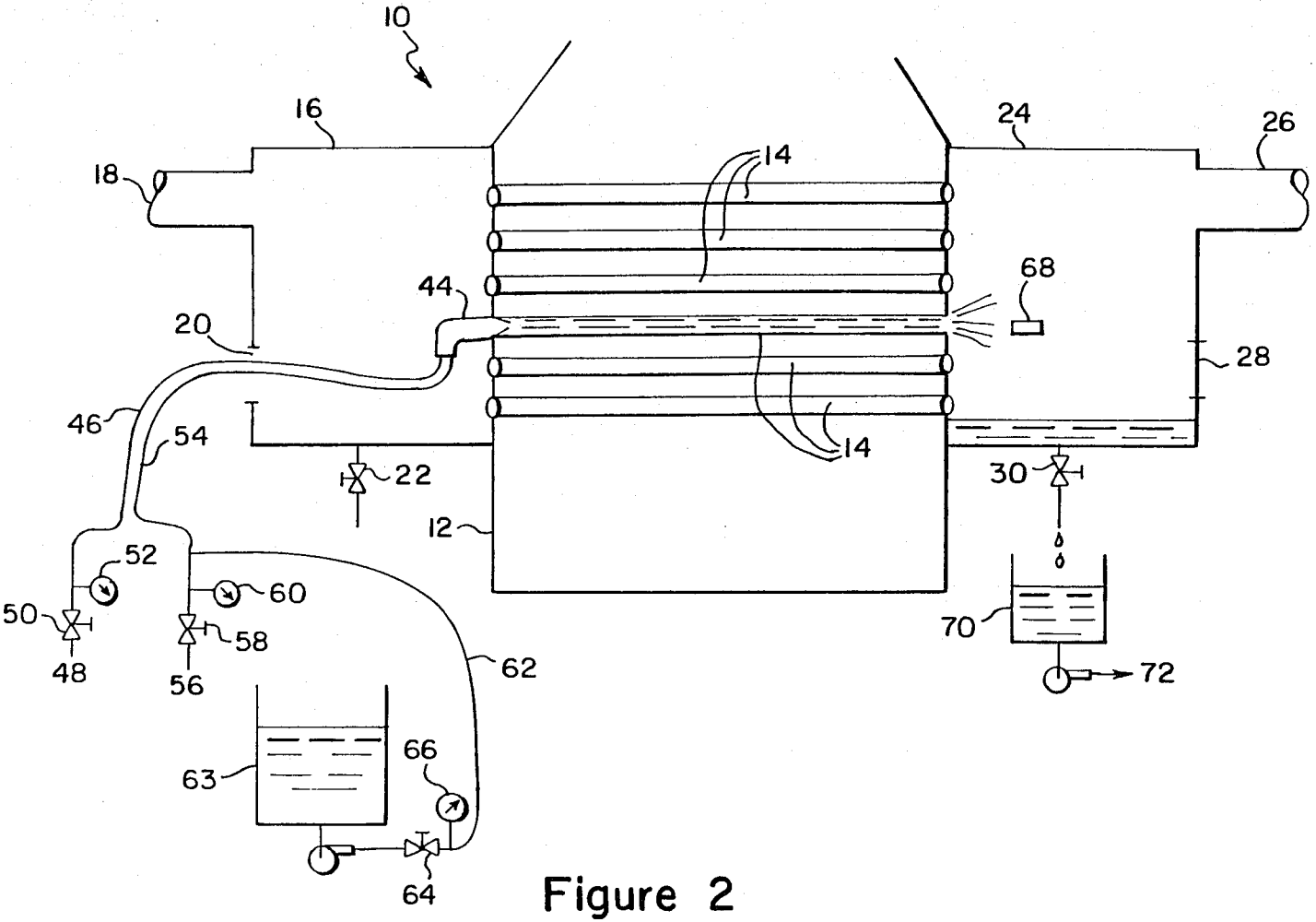
FIG. 2 is a side view showing the present invention cleaning the generally shown heat exchanger of FIG. 1.

Referring now to FIG. 2, the heat exchanger 10 is shown deactivated for cleaning. A gun 44 is connected by a first hose 46 to an air supply 48. A valve 50 and a gauge 52 control the pressure of the air entering the first hose 46 and ultimately entering the gun 44. A second hose 54 connects the gun 44 to a water supply 56. A valve 58 and a gauge 60 control the volume of the water entering the second hose 54 and ultimately the gun 44. A third hose 62 connects a chemical additives supply 63 to the second hose 54, downstream of the gauge 60. A valve 64 and a gauge 66 control the volume of the chemical additives supply 63 entering the third hose 62 to mix with the water 56 in the second hose 54.

In operation of the cleaning process, the manhole access 20 in the inlet water box 16 is opened and the gun 44 with the first hose 46 and the second hose 54 are passed therethrough. The gun 44 is placed against the opening of a straight parallel hollow tube 14 and the valves 52, 60, and 66 are opened. The gun 44 is triggered causing the air pressure in the first hose to enter the gun and syphon the water 56/chemical additives supply 63 mixture through the gun 44. The propellant propels a pig, brush, scraper or other similar device 68 through a straight parallel hollow tube 14. The propellant, waste product, and the pig, brush, scraper or other similar device 68 enter and fall to the bottom of the outlet water box 24. The aqueous waste 70 is collected and passed to the wastewater treatment plant 72. The process is repeated for each of the plurality of straight parallel hollow tubes 14 until all of the plurality of straight parallel hollow tubes 14 have been treated.

EXAMPLE

A project was conducted at a conventional power station which included using a ferrous sulfate ($FeSO_4$) treatment solution during the cleaning process of the heat exchanger tubes. Ferrous sulfate was the chemical of initial choice because it has been used to condition the heat exchanger coolant with some success and is environmentally acceptable. The intent of this treatment was to reduce the rate of corrosion in these tubes, kill biota and remove scale.

The objective of the project was to evaluate the benefits of adding treatment chemicals to the propellant water used for shooting cleaning devices (i.e., plastic pigs, brushes, etc.) through heat exchanger tubes.

The project involved injecting approximately 30 cc. of water per pig through approximately 10,000 heat exchanger tubes. Each tube was treated twice. The project took approximately one month to complete since the plant's maintenance schedule allowed only about 2500 tubes to be cleaned in this fashion per night and cleaning was conducted on a schedule of only two nights per week.

Ferrous sulfate at an concentration of 1 percent was tested under this program. The treatment was conducted on four separate occasions since a crew shoots approximately 2500 pigs per shift. The "treated" portion of the heat exchanger was returned to service after each shift of shooting. Since the "gun" uses about 30 cc. of water per cleaning device 20 and 95% of the water shot drains from the water box to floor drains that discharge to the wastewater treatment plant (WWTP), less than 0.1 lbs. of ferrous sulfate entered the discharge per 2500 tubes cleaned (2500 tubes$\times$30 cc./tube$\times$liter/1000 cc.$\times$10,000 mg/liter $\times$lb./454,000 mg.$\times$0.05 loss factor=0.083 lbs. ferrous sulfate per 2500 cleaned tubes). The remaining 5% was flushed out when the heat exchanger was placed back into service. The concentration of the discharged FeSO4 was less than 1 ppm for about four minutes. Grab samples were taken following the rinse operation, which demonstrated the environmental compatability of this treatment method.

It will be understood that each of the elements described above, or two or more together, may also find a useful application in other types of methods and constructions differing from the types described above.

While the invention has been illustrated and described as embodied in an improved process for cleaning tube type heat exchangers, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An improved process for cleaning heat exchanger tubes using propellant air water to shoot pigs, brushes, or scrapers, or similar devices through the heat exchanger tubes wherein the improvement comprises adding a minimal amount of a treatment chemical to the water portion of the air and water propellant which forms an aerosol mixture assuring chemical contact with the heat exchanger tubes so that corrosion and mechanical wear and scaling of the heat exchanger tubes are controlled, said minimal amount of the treatment chemical being environmentally acceptable because the waste is also a minimal amount due to said minimal amount of said treatment chemical, the treatment easily capturing and processing said waste in an approved waste water treatment plant and said treatment being substantially less costly because only said minimal amount of chemicals are required per treatment and being a variety of chemicals used singularly and in combination, said water portion of said air and water propellant mixture lubricates the pigs, brushes, or scrapers as they travel through the heat exchanger tubes, the expansion of the air portion of said air and water propellant mixture propels the pigs, brushes, or scrapers to travel through the heat exchanger tubes.

2. The improved process as defined in claim 1, wherein said treatment chemical is at least 10,000 ppm.

3. The improved process as defined in claim 1, wherein said treatment chemical is inorganic.

4. The improved process as defined in claim 1, wherein said treatment chemical is organic.

5. The improved process as defined in claim 1, wherein said treatment chemical is an acid.

6. The improved process as defined in claim 1, wherein said treatment chemical is a base.

7. The improved process as defined in claim 1, wherein said treatment chemical is an oxidizer.

8. The improved process as defined in claim 1, wherein said treatment chemical is a reducer.

9. The improved process as defined in claim 1, wherein said treatment chemical is ferrous sulfate.

10. The improved process as defined in claim 1, wherein said treatment chemical is sodium hypochlorite.

11. The improved process as defined in claim 1, wherein said treatment chemical is hydrogen peroxide.

* * * * *